US006283218B1

(12) United States Patent
Collins

(10) Patent No.: US 6,283,218 B1
(45) Date of Patent: Sep. 4, 2001

(54) LOCATING AND LOCKING MANDREL FOR FLOW CONTROL DEVICE

(75) Inventor: Leo G. Collins, Lewisville, TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 09/353,722

(22) Filed: Jul. 14, 1999

(51) Int. Cl.[7] ..... E21B 23/02
(52) U.S. Cl. ..... 166/382; 166/115; 166/208
(58) Field of Search ..... 166/382, 387, 166/208, 217, 115

(56) References Cited

U.S. PATENT DOCUMENTS 4,545,434 * 10/1985 Higgins ..... 166/217
4,657,077 * 4/1987 Smith, Jr. et al. ..... 166/115
5,390,735 * 2/1995 Williamson, Jr. ..... 166/115
5,538,082 * 7/1996 Zwart ..... 166/382
5,865,255 * 2/1999 Hammett et al. ..... 166/115

OTHER PUBLICATIONS

Otis Wireline Subsurface Flow Controls & Related Service Equipment Brochure, cover page, pp. 2 and 22 date 1980.

* cited by examiner

*Primary Examiner*—William Neuder
(74) *Attorney, Agent, or Firm*—Paul I. Herman; Marlin R. Smith

(57) ABSTRACT

A locating and locking mandrel and associated nipple provide for positioning an item of equipment in large bore and high weight conditions. In a described embodiment, a locating and locking mandrel includes at least one collect which is configured to cooperatively engage an internal profile of a nipple. The collect is capable of supporting the weight of the item of equipment until at least one locking member of the mandrel is engaged with another internal profile of the nipple. A seal of the mandrel is received in a seal bore of the nipple prior to insertion of the locating member or locking member into the seal bore, thereby preventing damage to the seal bore.

17 Claims, 4 Drawing Sheets

LOCATING AND LOCKING MANDREL FOR FLOW CONTROL DEVICE

BACKGROUND OF THE INVENTION

The present invention relates generally to positioning items of equipment within a subterranean well and, in an embodiment described herein, more particularly provides a locating and locking mandrel system.

When positioning an item of equipment, such as a wireline-conveyed subsurface safety valve, within a tubing string installed in a subterranean well, it is common practice to attach a lock mandrel to the valve and then convey the valve and lock mandrel into the string. The lock mandrel is then operatively engaged with a nipple interconnected in the string. Typically, the engagement between the mandrel and the nipple anchors the valve in position in the string and seals the valve to the string, so that flow through the string is constrained to pass through the valve.

When initially positioned in the nipple, it is typical for the weight of the valve to be supported by a no-go member of the mandrel. The no-go member may be a cylindrical member or ring having an outer diameter somewhat greater than an inner no-go diameter of the nipple. In this manner, engagement between the no-go member and the no-go diameter prevents the mandrel from passing through the nipple and thereby supports the weight of the valve on the no-go diameter. After the no-go member has engaged the no-go diameter, a locking member, such as a radially extendable dog or lug, is engaged with an internal profile of the nipple, in order to lock or anchor the mandrel in position relative to the nipple.

However, it has become increasingly prevalent to utilize large diameter tubing strings with large seal bores in wells, in order to maximize fluid flow therethrough. In designing tools for use in such large diameter tubing strings, the tool designer is faced with several problems. Larger diameter tools tend to have increased weight and, thus, in the typical lock mandrel and nipple system, increased weight must be borne by the no-go diameter of the nipple when engaged by the no-go member. Additionally, in order to provide a larger bore, the wall thickness of the nipple may be decreased, so that only a small area is available to support the weight of the valve.

Furthermore, lock mandrels and nipples have in the past required that a radially outwardly extending or biased locating and/or locking member of the mandrel, such as the lugs or dogs mentioned above, pass through a seal bore of the nipple before a seal of the mandrel sealingly engages the seal bore. It will be readily appreciated that this situation may cause damage to the seal bore by the locating and/or locking member, so that the seal cannot effectively engage the seal bore.

From the foregoing, it may be seen that it would be highly advantageous to provide a locating and locking mandrel system which is specially adapted for use in situations in which it is undesirable to support the weight of an item of equipment on a no-go diameter of a nipple. Additionally, it would be advantageous to provide a locating and locking mandrel system in which a seal surface of a nipple is protected from damage due to contact with a locating and/or locking member of the mandrel.

SUMMARY OF THE INVENTION

In carrying out the principles of the present invention, in accordance with an embodiment thereof, a locating and locking mandrel system is provided which does not require supporting the weight of an item of equipment on a no-go diameter of a nipple. The system also does not require that a locating or locking member of the nipple pass through a seal surface of the nipple.

In one aspect of the present invention, a locating and locking mandrel includes colleted locating members which engage an internal profile of a nipple. When engaged with the internal profile, the locating members are capable of supporting the weight of an item of equipment attached to the mandrel. With the weight supported by the locating members, separate locking members of the mandrel may then be operatively engaged with another internal profile of the nipple to thereby anchor the item of equipment relative to the nipple.

In another aspect of the present invention, the mandrel also includes a seal configured for sealing engagement with a seal surface of the nipple. The seal is downwardly disposed on the mandrel relative to the locating and locking members. In this manner, the seal engages the seal surface without the locating or locking members passing through or engaging the seal surface.

In yet another aspect of the present invention, the mandrel may include a backup no-go member, for use in the event that the locating members do not operatively engage the internal profile of the nipple. However, in the described embodiments, the no-go member does not contact a no-go diameter of the nipple in normal operation of the mandrel system.

In still another aspect of the present invention, the mandrel is constructed in a compact and efficient manner, with portions thereof positioned and configured for enhanced effectiveness, reduction of cost and reliable operation. For example, the mandrel is constructed with reduced moving parts, a reduced number of parts, a reduced number of threaded joints and with features that increase its reliability in operation.

These and other features, advantages, benefits and objects of the present invention will become apparent to one of ordinary skill in the art upon careful consideration of the detailed description of representative embodiments of the invention hereinbelow and the accompanying drawings.

DETAILED DESCRIPTION

Figure 1:
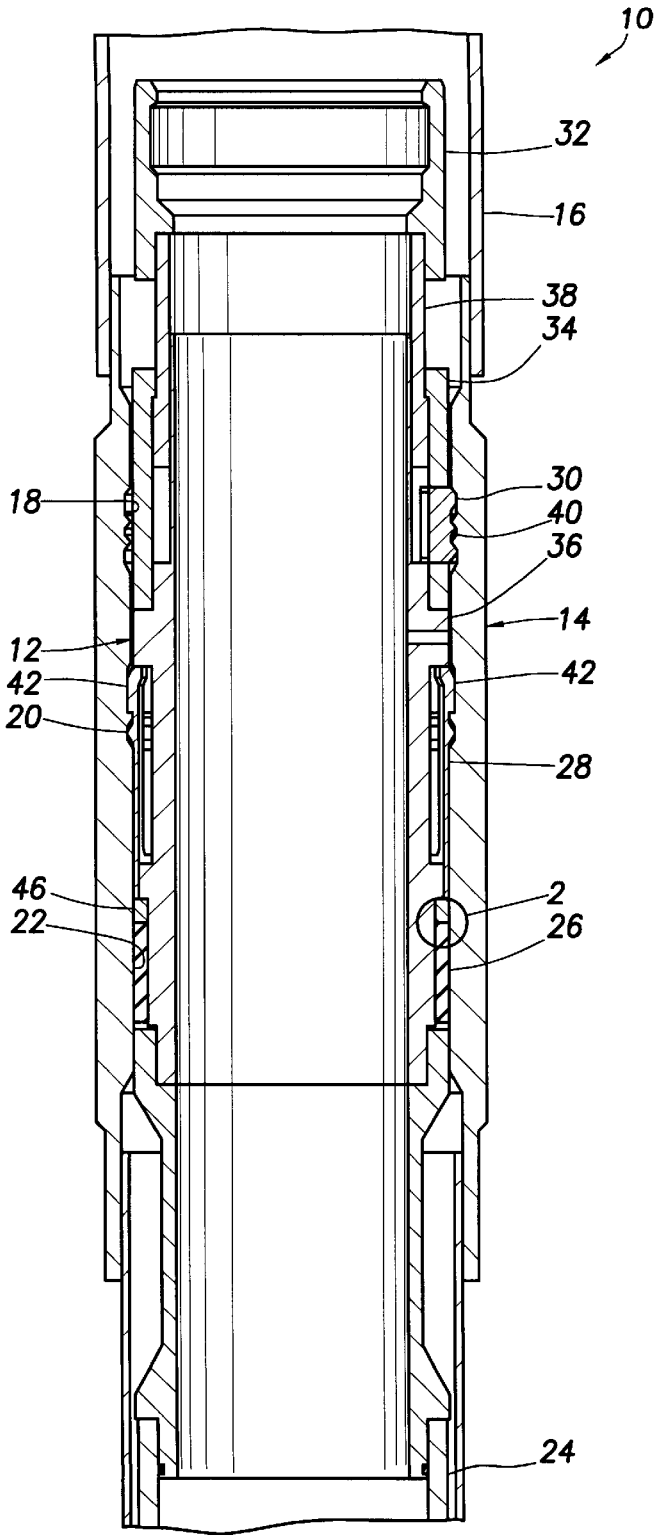
FIG. 1 is a cross-sectional view of a first locating and locking mandrel system embodying principles of the present invention, a mandrel of the mandrel system being shown in a configuration in which it is conveyed into a nipple.

Representatively illustrated in FIG. 1 is a locating and locking mandrel system 10 which embodies principles of the present invention. In the following description of the mandrel system 10 and other apparatus and methods described herein, directional terms, such as "above", "below", "upper", "lower", etc., are used for convenience in referring to the accompanying drawings. Additionally, it is to be understood that the various embodiments of the present invention described herein may be utilized in various orientations, such as inclined, inverted, horizontal, vertical, etc., without departing from the principles of the present invention.

The mandrel system 10 includes a locating and locking mandrel 12 and a nipple 14. The nipple 14 is configured for interconnection in a tubular string 16 installed in a subterranean well. The nipple 14 includes an upper internal circumferential recess or locking profile 18, a middle internal circumferential recess or locating profile 20 and an inner seal surface or seal bore 22. Note that the seal bore 22 is positioned below the locking and locating profiles 18, 20.

The mandrel 12 is configured for positioning an item of equipment attached thereto, such as a subsurface safety valve 24, relative to the nipple 14. The mandrel 12 includes a seal or seals 26, such as packing, a series of circumferentially spaced apart locating members or collets 28, a series of circumferentially spaced apart locking members or keys 30 (only one of which is visible in FIG. 1) and an upper running/retrieving head 32.

A key retainer sleeve 34 secures the keys 30 relative to a tubular housing 36 of the mandrel 12. The retainer sleeve 34 permits the keys 30 to displace radially relative to the housing 36, but prevents axial displacement of the keys relative to the housing.

Figure 3:
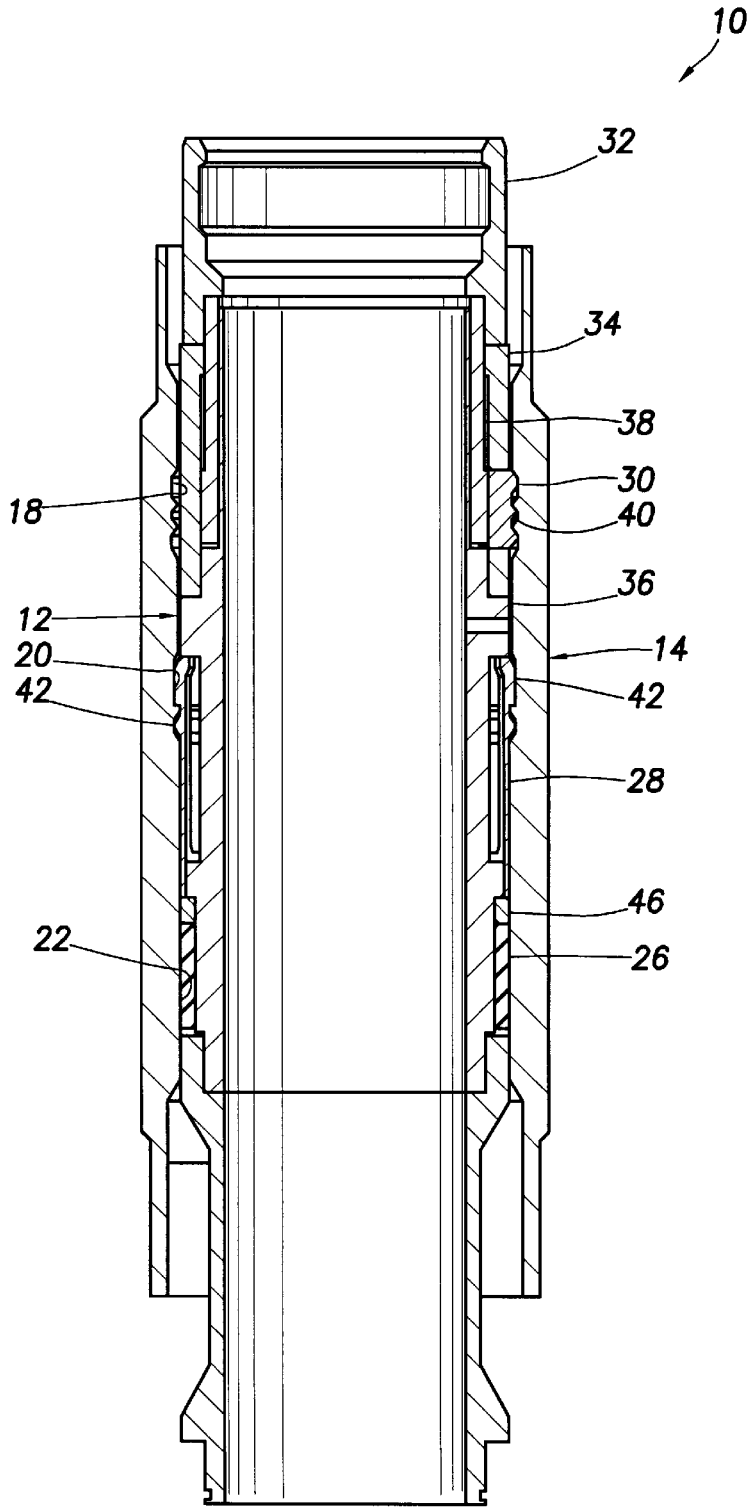
FIG. 3 is a cross-sectional view of the mandrel system of FIG. 1, the mandrel being shown in a configuration in which it is locked in position relative to the nipple.

A locking sleeve 38 is attached to the head 32 and is axially slidably received between the retainer sleeve 34 and the housing 36. When in its upwardly disposed position relative to the keys 30 as shown in FIG. 1, the keys are permitted to displace radially inward. However, when the locking sleeve 38 is displaced downwardly, it maintains the keys 30 in a radially outwardly disposed position as shown in FIG. 3. Each of the keys 30 has an external profile 40 formed thereon which is cooperatively shaped relative to the locking profile 18 of the nipple 14, so that when the mandrel 12 is operatively positioned within the nipple and the locking sleeve 38 is downwardly displaced, the key profiles engage the locking profile and thereby prevent displacement of the mandrel and the valve 24 relative to the nipple and the tubing string 16. Such downward displacement of the locking sleeve 38 may be accomplished by applying set down weight to the head 32 via a conventional running tool engaged with the head, in a manner well known to those skilled in the art.

Each of the locating collets 28 has an external profile 42 formed thereon. The profiles 42 are configured to cooperatively engage the locating profile 20 of the nipple 14 and prevent downward displacement of the mandrel 12 through the nipple. The collets 28 are resilient and radially inwardly displaceable so that, as the mandrel 12 is lowered through the tubing string 16, the collets "seek" the cooperatively configured profile 20. The profiles 20, 42 may be only one set out of multiple sets of differently configured profiles, so that the collets 28 will only cooperatively engage a particular profile formed in the nipple 14 out of perhaps multiple differently configured profiles in the tubing string 16. In this manner, the collets 28 may be "selective" in that they will only cooperatively engage one or more of multiple nipple profiles in order to locate the mandrel 12 in an appropriate desired nipple.

When the collet profiles 42 engage the nipple profile 20, the engagement between the profiles stops the downward displacement of the mandrel 12, thereby locating the mandrel within the nipple. Such engagement between the collets 28 and the nipple 14 also supports the weight of the mandrel and valve 24.

The seal 26 is positioned on the mandrel 12 below the keys 30 and the collets 28. The seal 26 accordingly engages the seal bore 22 below the profiles 18, 20 in the nipple 14. Thus, neither the keys 30 nor the collets 28 pass through the seal bore 22, and there is no danger that the keys or collets will damage the seal bore. In the embodiment shown in FIGS. 1–3, the seal 26 sealingly engages the seal bore 22 prior to the collets 28 engaging the profile 20 or the keys 30 engaging the profile 18.

The mandrel system 10 is shown in FIG. 1 with the mandrel 12 in its configuration as it is lowered through the tubing string 16. When the collets 28 engage the profile 20, the mandrel 12 cannot displace further downwardly relative to the nipple 14. Thereafter, when it is desired to lock the mandrel 12 in position relative to the nipple 14, the head 32 and locking sleeve 38 are displaced downwardly relative to the housing 36, thereby forcing the keys 30 radially outward into engagement with the profile 18. FIG. 3 shows the mandrel system 10 after the head 32 and locking sleeve 38 have been displaced downwardly.

Figure 2:
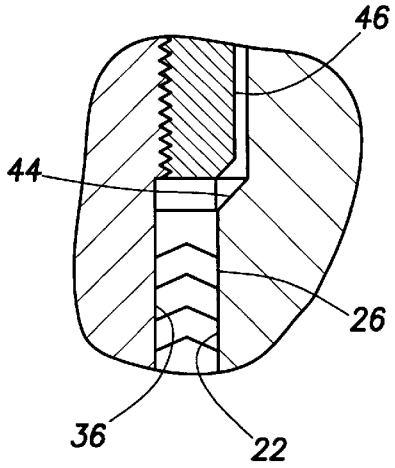
FIG. 2 is an enlarged scale cross-sectional view of a portion of the mandrel system of FIG. 1.

Referring additionally now to FIG. 2, an enlarged view is shown of a portion of the mandrel system 10 encircled and indicated by the reference number 2 in FIG. 1. In this view, it may be seen that a relatively small no-go shoulder 44 is formed internally on the nipple 14. The mandrel 12 includes a no-go member or retainer ring 46 which is utilized to retain the collets 28 on the housing 36.

The no-go ring 46 has an outer diameter which is greater than the inner diameter of the no-go shoulder 44. Thus, engagement between the no-go ring 46 and the shoulder 44 may be utilized to prevent downward displacement of the mandrel 12 relative to the nipple 14. However, note that there is a gap between the no-go ring and the shoulder 44, due to the collets 28 being engaged with the profile 20. The no-go ring 46, therefore, acts as a secondary locating device, in the event that the collets 28 do not operatively engage the profile 20. If the collets 28 do not engage the profile 20 and the mandrel 12 is permitted to displace downward far enough for the no-go ring 46 to contact the shoulder 44, the mandrel will still be operatively positioned within the nipple 14 so that the keys 30 may be radially outwardly extended into engagement with the profile 18.

Figure 4:
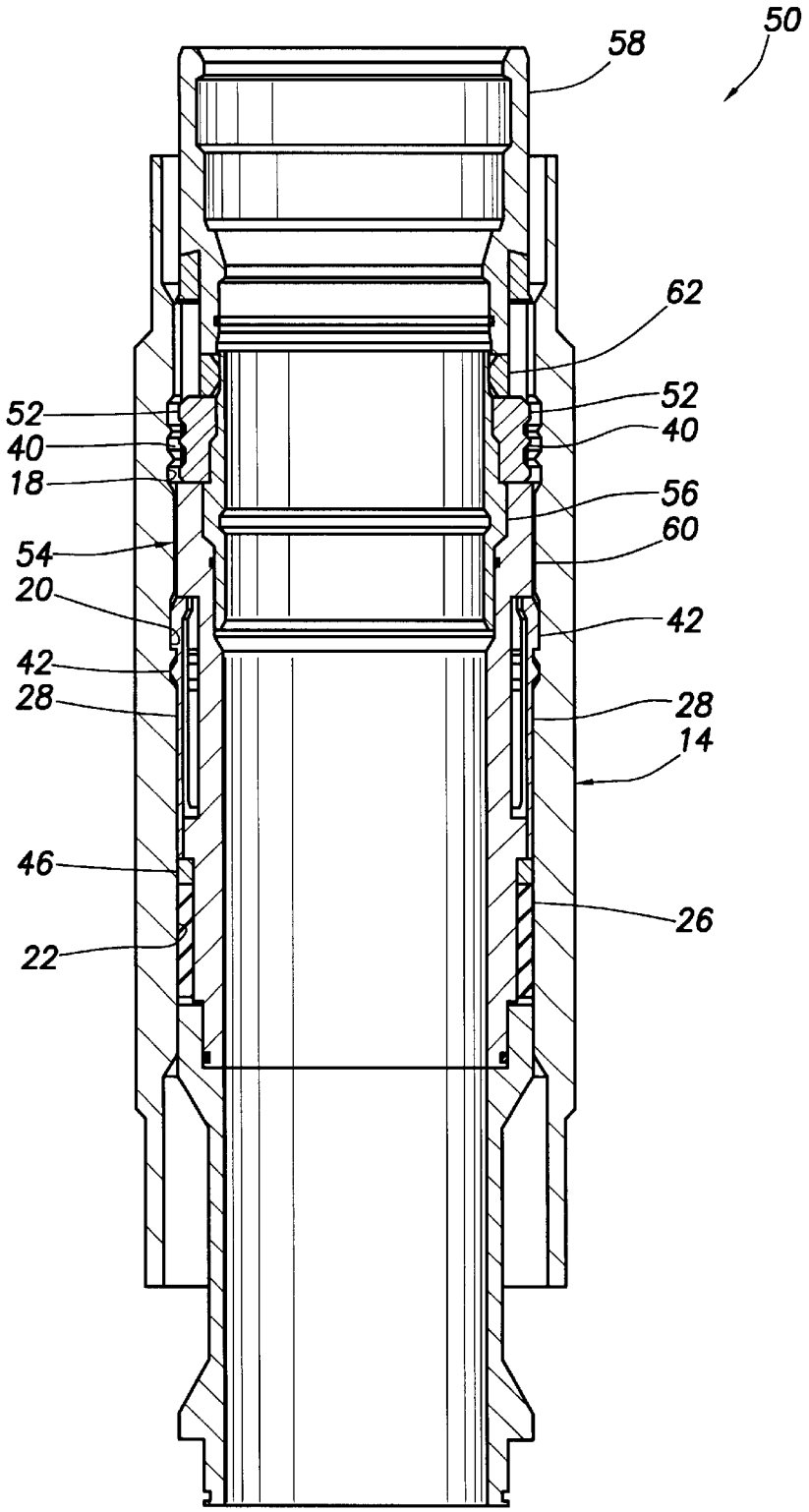
FIG. 4 is a cross-sectional view of a second locating and locking mandrel system embodying principles of the present invention, a mandrel of the mandrel system being shown in a configuration in which it is conveyed into a nipple.
Figure 5:
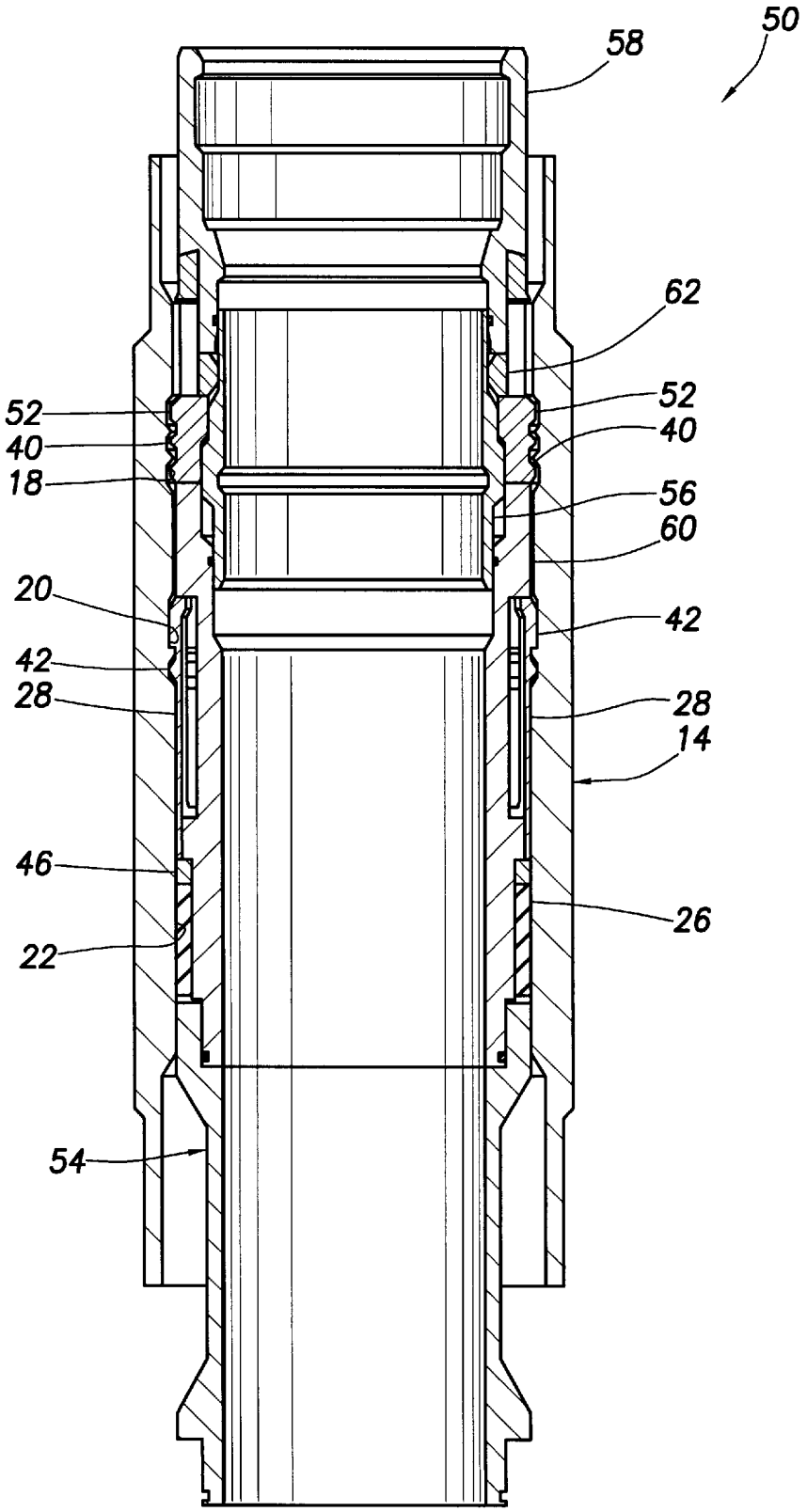
FIG. 5 is a cross-sectional view of the mandrel system of FIG. 4, the mandrel being shown in a configuration in which it is locked in position relative to the nipple.

Referring additionally now to FIGS. 4 & 5, another locating and locking mandrel system 50 embodying principles of the present invention is representatively illustrated. The mandrel system 50 is very similar in many respects to the mandrel system 10 described above, differing mainly in the manner in which locking keys 52 are radially outwardly extended. Therefore, elements shown in FIGS. 4 & 5 which are the same as, or similar to, elements shown in FIGS. 1, 2 & 3 are indicated using the same reference numbers.

The mandrel system 50 includes a mandrel 54 in which, instead of displacing one or more members, such as the head 32 and locking sleeve 38, downward to bring keys 30 into locking engagement with the profile 18, a locking sleeve 56 is displaced upward to radially outwardly engage the keys 52 with the profile. Additionally, a head 58 of the mandrel 54 is attached to a housing 60 of the mandrel, and does not displace with the locking sleeve 56. Note that the mandrel 54 does not include a separate key retainer, since the housing 60 also performs the function of retaining the keys 52.

In FIG. 4 the mandrel 54 is shown in a configuration in which it is conveyed into a tubular string, such as the string 16, with the collets 28 engaged with the profile 20 and supporting the weight of any item of equipment, such as the valve 24, which may be attached to the mandrel. Note that in this configuration the keys 52 are not radially outwardly supported by the locking sleeve 56. In FIG. 5, the mandrel 54 is shown in a configuration in which the locking sleeve 56 has been upwardly displaced and now radially outwardly supports the keys 52 in engagement with the profile 18.

A generally C-shaped snap ring or C-ring 62 releasably maintains the locking sleeve 56 in either its upwardly or downwardly disposed position relative to the housing 60. The locking sleeve 56 may be displaced between its upwardly and downwardly disposed positions by utilizing a conventional shifting tool or running/retrieving tool well known to those skilled in the art.

Retrieval of either the mandrel 12 or the mandrel 54, with attached valve 24 or other item of equipment, is accomplished by displacing the locking sleeve 38 upwardly or by displacing the locking sleeve 56 downwardly, respectively, and applying an upward force to the head 32 or to the head 58, respectively. With the keys 30 or 52 no longer radially outwardly supported in locking engagement with the profile 18, the keys will displace radially inward, due to cooperating inclined surfaces formed on the keys and the profile. The collets 28 will not prevent upward displacement of the mandrel 12 or 54, since the profiles 20, 42 are configured to prevent downward displacement of the collets relative to the nipple 14 when the profiles are engaged, but are not configured to prevent upward displacement of the collets relative to the nipple. The upper ends of the collets 28 will be radially inwardly displaced out of engagement with the profile 20 by cooperating inclined surfaces formed on the profiles 20, 42 when the collets displace upwardly relative to the profile 20.

Thus have been described the mandrel systems 10 and 50 which solve the problems presented by use of large diameter tubing strings having large bores and minimum wall thickness for provision of no-go surfaces. The mandrel systems 10 and 50 also provide simplicity and economy of manufacture, and convenience and reliability in operation.

Of course, a person skilled in the art would, upon a careful consideration of the above description of representative embodiments of the invention, readily appreciate that many modifications, additions, substitutions, deletions, and other changes may be made to these specific embodiments, and such changes are contemplated by the principles of the present invention. Accordingly, the foregoing detailed description is to be clearly understood as being given by way of illustration and example only, the spirit and scope of the present invention being limited solely by the appended claims.

What is claimed is:

1. A locating and locking mandrel for positioning an item of equipment relative to a nipple interconnected in a tubular string installed in a subterranean well, the mandrel comprising:

at least one collet having an external profile formed thereon, the collet engaging an internal profile of the nipple, and engagement of the internal and external profiles supporting the item of equipment, when the mandrel is received within the nipple, and preventing displacement of the mandrel through the nipple in a first axial direction; and a rigid no-go member having an outer dimension greater than a minimum inner dimension of the nipple, whereby the mandrel is prevented from displacing through the nipple.

2. The mandrel according to claim 1, wherein the mandrel includes a plurality of the collets.

3. The mandrel according to claim 1, wherein the collets are circumferentially spaced apart.

4. A locating and locking mandrel for positioning an item of equipment relative to a nipple interconnected in a tubular string installed in a subterranean well, the mandrel comprising:

at least one collet having an external profile formed thereon, the collet engaging an internal profile of the nipple, and engagement of the internal and external profiles supporting the item of equipment, when the mandrel is received within the nipple; and a rigid no-go member having an outer dimension greater than a minimum inner dimension of the nipple, whereby the mandrel is prevented by the no-go member from displacing through the nipple, the collet engaging the nipple internal profile, prior to engagement of the no-go member with the nipple inner dimension, when the mandrel is received in the nipple.

5. A locating and locking mandrel for positioning an item of equipment relative to a nipple interconnected in a tubular string installed in a subterranean well, the mandrel comprising:

at least one collet having an external profile formed thereon, the collet engaging an internal profile of the nipple, and engagement of the internal and external profiles supporting the item of equipment, when the mandrel is received within the nipple, and preventing displacement of the mandrel through the nipple in a first axial direction;

at least one locking member configured for releasably preventing displacement of the mandrel relative to the nipple;

a seal configured for sealingly engaging a seal surface of the nipple, the collet being positioned between the locking member and the seal; and a rigid no-go member having an outer dimension greater than a minimum inner dimension of the nipple, the no-go member being positioned between the collet and the seal.

6. A locating and locking mandrel for positioning an item of equipment relative to a nipple interconnected in a tubular string installed in a subterranean well, the mandrel comprising:

at least one locating member configured to engage the nipple and prevent displacement of the mandrel through the nipple in a first axial direction;

at least one locking member configured to engage the nipple and prevent displacement of the mandrel relative to the nipple in the first direction and in a second axial direction opposite to the first axial direction; and a seal configured to sealingly engage the nipple in response to insertion of the mandrel into the nipple, and wherein one of the locking member and the locating member is positioned between the seal and the other of the locking member and the locating member, and the at least one locking member is operable independently of the seal.

7. The mandrel according to claim 6, wherein the locking member is a key configured to radially outwardly engage an internal profile of the nipple.

8. A locating and locking mandrel for positioning an item of equipment relative to a nipple interconnected in a tubular string installed in a subterranean well, the mandrel comprising:

at least one locating member configured to engage the nipple and prevent displacement of the mandrel through the nipple in a first axial direction;

at least one locking member configured to engage the nipple and prevent displacement of the mandrel relative to the nipple in the first direction and in a second axial direction opposite to the first axial direction;

a seal configured to sealingly engage the nipple when the mandrel is operatively received in the nipple, wherein one of the locking member and the locating member is positioned between the seal and the other of the locking member and the locating member; and a rigid no-go member positioned between the seal and the locating member.

9. A locating and locking mandrel system for positioning an item of equipment in a tubular string installed in a subterranean well, the system comprising:

a nipple interconnectable in the tubing string, the nipple having a first internal profile and an internal shoulder; and a mandrel including a rigid no-go member configured to prevent displacement of the mandrel through the nipple when the no-go member engages the nipple internal shoulder, and at least one locating member, the locating member engaging the first internal profile prior to engagement of the no-go member with the nipple internal shoulder when the mandrel is operatively inserted into the nipple.

10. The system according to claim 9, wherein the mandrel further comprises at least one locking member radially outwardly extendable into locking engagement with a second internal profile of the nipple.

11. The system according to claim 10, wherein the mandrel further comprises a seal sealingly engageable with an internal seal surface of the nipple.

12. The system according to claim 11, wherein one of the locating member and the locking member is positioned between the seal and the other of the locating member and the locking member.

13. The system according to claim 11, wherein the seal sealingly engages the seal surface prior to engagement of the locating member with the first internal profile and prior to engagement of the locking member with the second internal profile when the mandrel is operatively inserted into the nipple.

14. The system according to claim 11, wherein the seal surface is a seal bore, and wherein the seal is received within the seal bore prior to insertion of the locating member into the seal bore and prior to insertion of the locking member into the seal bore when the mandrel is operatively inserted into the nipple.

15. A method of positioning an item of equipment relative to a tubular string in a subterranean well, the method comprising the steps of:

interconnecting a nipple in the tubular string, the nipple including an internal seal surface;

conveying the item of equipment attached to the mandrel into the tubular string, the mandrel including an external seal, at least one locating member and at least one locking member;

sealingly engaging the seal with the nipple seal surface; and interengaging the locating member with the nipple in a manner preventing movement of the mandrel through the nipple in a first axial direction, the sealingly engaging step being performed prior to the interengaging step.

16. The method according to claim 15, wherein in the conveying step, the mandrel is configured with one of the locating member and locking member positioned between the seal and the other of the locating member and the locking member.

17. The method according to claim 15, wherein in the sealingly engaging step, the seal and the seal surface are positioned below the locating member and the locking member.

* * * * *